United States Patent [19]

Eicher et al.

[11] 4,296,762

[45] Oct. 27, 1981

[54] SMOKABLE PRODUCTS

[75] Inventors: Theobald Eicher, Dormagen; Friedemann Müller, Neuss, both of Fed. Rep. of Germany

[73] Assignee: Bayer Aktiengesellschaft, Leverkusen, Fed. Rep. of Germany

[21] Appl. No.: 915,490

[22] Filed: Jun. 14, 1978

[30] Foreign Application Priority Data

Jul. 1, 1977 [DE] Fed. Rep. of Germany ..... 2729759

[51] Int. Cl.[3] ..... A24B 15/30; A24B 15/42; A24D 1/18

[52] U.S. Cl. ..... 131/359; 151/369

[58] Field of Search ..... 131/2, 140 C, 17, 15 C, 131/140 B

[56] References Cited

U.S. PATENT DOCUMENTS 3,046,996 7/1962 Gary ..... 131/17 R 3,924,642 12/1975 Eicher ..... 131/262 A

*Primary Examiner*—V. Millin

*Attorney, Agent, or Firm*—Sprung, Felfe, Horn, Lynch & Kramer

[57] ABSTRACT

A smokable product based on cellulose and combustion-modifying substances, containing (a) 0.1–10% by weight, based on the total weight of the smokable product, of finely divided solids, the average particle diameter of which is less than 2$\mu$, in a distribution which is heterogeneous over the cross-section of the smokable product, with an enrichment in or on the surfaces, and (b) 0.5–15% by weight, based on the total weight of the smokable product, of salts of monobasic or polybasic carboxylic acids. The product being prepared by saturating, spraying or coating a combustible, prefabricated material which is based on cellulose and optionally contains fillers customarily used in smokable products and which can be used as a smokable product with a dispersion of solids, the average particle diameter of which is less than 2$\mu$, in a solution of salts of monobasic or polybasic carboxylic acids.

12 Claims, No Drawings

SMOKABLE PRODUCTS

The invention relates to improved smokable products based on cellulose and combustion-modifying substances and a process for their preparation.

In British Pat. No. 909,699, water-absorbent substances, especially activated aluminium hydroxide, activated bauxite or aluminium hydroxide, are described which are added in the form of powders in amounts of at least 20% by weight to cut tobacco or reconstituted tobacco, are incorporated in reconstituted tobacco sheets or are incorporated in amounts of 5–10% by weight into paper pulps intended for the production of cigarette paper or are used for coating cigarette paper. These water-absorbent substances serve to liberate water in the combustion zone and thus to lower the combustion temperature of the product for smoking. However, they do not improve the organoleptic properties of the product for smoking and also do not contribute to increasing the bulk volume of the tobacco. It is a disadvantage that the processability of the tobacco mixtures on conventional cigarette machines is made considerably more difficult by the addition of the finely divided water-absorbent substances described, since the requisite slip properties of the pre-formed tobacco tow on metal surfaces and others are impaired.

Smokable products which contain a combustible material based on cellulose and alkaline earth metal and/or manganese-II/metal-III chelate compounds, compounds which split off ammonia, oxidising agents, fillers, binders, tobacco constituents and/or further conventional additives are known from U.S. Pat. No. 3,924,642.

The smoke analyses of the smokable products described in this U.S. Pat. No. 3,924,642 show a distinct reduction, compared with tobacco, in the physiologically harmful substances in the smoke, coupled with an impression of taste which is satisfactory in some cases and is without cellulose sharpness and without undesirable superposition of the tobacco-specific aroma components on admixture with various tobaccos.

However, it has proved to be a disadvantage that when these smokable products are mixed with tobacco it is not possible, without a distinct impairment in the organoleptic properties, to obtain any lowering in the content of harmful substances in the smoke which markedly exceeds that to be expected on the basis of the mixing ratio and the values of the individual components. Furthermore it has been found that the compatibility of the smokable products, especially when mixed with low-condensate and low-nicotine tobaccos, which are becoming increasingly important, is restricted.

Surprisingly, it has now been found that the disadvantages of the smokable products described can be avoided when finely divided solids are so applied to the smokable products based on cellulose and combustion-modifying substances that the distribution achieved is heterogeneous over the cross-section of the smokable product, with an enrichment in or on the surfaces.

The smokable products, based on cellulose, according to the invention are distinguished in particular by a reduced content of harmful substances in the smoke and/or improved organoleptic properties and by the fact that, in admixtures with various tobaccos, they advantageously influence the combustion characteristics of the total mixture in such a way that a considerably greater, disproportionate reduction in the harmful substance components in the smoke is achieved than can be expected on the basis of the individual values for the components of the mixture. In addition, the smokable products according to the invention have an improved wet strength, increased mechanical strength, which leads to the formation of lesser amounts of dust during processing, and an increased bulk volume under processing conditions in the moist state.

The invention therefore relates to smokable products based on cellulose and combustion-modifying substances; the products are characterised in that they contain (a) 0.1–10% by weight, based on the total weight of the smokable product, of finely divided solids, the average particle diameter of which is less than 2$\mu$, in a distribution which is heterogeneous over the cross-section of the smokable product, with an enrichment in or on the surfaces, and (b) 0.5–15% by weight, based on the total weight of the smokable product, of salts of monobasic or polybasic carboxylic acids.

The invention also relates to a process for the preparation of these smokable products, based on cellulose and combustion-modifying substances; the process is characterised in that the combustible, prefabricated material which is based on cellulose and optionally contains fillers customarily used in smokable products and which can be used as a smokable product is saturated, sprayed or coated with a dispersion of solids, the average particle diameter of which is less than 2$\mu$, in a solution of salts of monobasic or polybasic carboxylic acids.

In the known smokable products, the fillers are uniformly distributed. This uniform distribution is achieved by already adding the fillers during the production of the combustible carrier material.

In contrast to this, the finely divided solids in the smokable products according to the invention are non-uniformly distributed over the cross-section of the products and enriched on or in the surfaces. This heterogeneous distribution is achieved by not adding the solids during the preparation of the combustible carrier material but by saturating, spraying or coating only the prefabricated carrier of combustible material with dispersions of the solids in salt solutions.

Fillers, pigments and adsorbents which are in themselves known can be used to prepare the dispersions, to be used according to the invention, of finely divided solids in aqueous salt solutions, the requisite particle size being produced by dispersion or condensation and a reconversion into the initial states being prevented by the generation of an electric charge, solvatation or firmly adhering films (compare Ullmann's Encyklopädie der technischen Chemie (Ullmann's Encyclopaedia of Industrial Chemistry), 3rd edition, Volume 10, page 604 et seq., Urban & Schwarzenberg, Munich-Berlin, 1958). The dispersions are obtained by known processes, for example by dispersing solids using suitable dispersing equipment, colloid mills or ultrasonic sound, mechanical comminution being effected at the same time if desired. It is essential that dispersions are obtained which are stable under processing conditions. Electrostatically stabilised solids dispersions which consist of an external aqueous phase and an internal solids phase and have an average particle diameter of less than 2$\mu$ and preferably of 1.5–0.01$\mu$ are preferably employed.

The dispersions to be used according to the invention are preferably prepared by peptisation of the primary particles from secondary agglomerates, for example from precipitates obtained by precipitation or hydrolysis, by producing sols by adding peptising agents (electrolyte) or by washing out the excess electrolyte acting as the precipitant. The addition of protective colloids, for example gelatine, gum arabic, polyols, carboxymethylcellulose or wetting agents can in some cases be advantageous when preparing the dispersions.

Solids which have proved suitable are, above all, carbon and/or inorganic oxygen compounds of polyvalent elements, such as the alkaline earth metals, aluminium, iron, manganese, zinc, titanium and silicon. Inorganic oxygen compounds of polyvalent elements which are preferably used are the oxides, hydroxides and hydrated oxides of aluminium, iron, manganese, zinc, titanium and silicon or mixtures thereof.

Examples of solids which may be mentioned are the crystalline oxides, hydroxides or hydrated oxides of aluminium, iron, manganese, titanium, zinc or silicon, diatomaceous earth, clay minerals, active charcoal and vermiculite. Insoluble oxygen compounds of polyvalent elements, such as aluminium phosphate, aluminium hydroxide or iron hydroxide, can have been precipitated onto these substances. Preferred solids for the preparation of the aqueous dispersions to be used according to the invention are, however, those amorphous or partially crystalline hydrated oxides and/or hydroxides of aluminium, iron, manganese, zinc, titanium or silicon which have been obtained by precipitation from salt solutions and by washing out the excess electrolyte.

For example, suitable hydrated aluminium oxides of the formula $Al_2O_3.n\ H_2O$ are obtained by crystallisation from aluminate solution by the Bayer process (compare Ullmann's Encyklopädie der technischen Chemie (Ullmann's Encyclopaedia of Industrial Chemistry), 4th edition, Volume 6, page 305 et seq., Verlag Chemie, Weinheim, 1974), by precipitation with acids from aluminate solutions or by precipitation with bases, especially with ammonia, from aqueous solutions of aluminium salts and subsequent washing out. Hydrated iron oxides of the formula $Fe_2O_3.n\ H_2O$ are obtained by processes which are in themselves known, for example by the Penniman process (compare Ullmann's Encyklopädie der technischen Chemie (Ullmann's Encyclopaedia of Industrial Chemistry), 3rd edition, Volume 13, page 737 et seq., Urban & Schwarzenberg, Munich-Berlin, 1962) or by hydrolysis or precipitation of soluble iron salts, for example $FeCl_3.6\ H_2O$.

The smokable products according to the invention contain the finely divided solids in amounts of 0.1–10% by weight, based on the total weight of the smokable product, preferably in amounts of 0.5–7.5% by weight and particularly preferentially in amounts of 1.0–5.0% by weight. The concentration of the solids in the dispersions to be used according to the invention should be 0.1–10% by weight.

The aqueous salt solutions to be used according to the invention for dispersing the finely divided solids are preferably solutions of water-soluble, non-toxic salts of monobasic or polybasic carboxylic acids. Those water-soluble salts which effect electrostatic stabilising of the solids dispersion, regulate the smouldering and combustion characteristics of the smokable products, prepared according to the invention, in an advantageous manner and/or split off ammonia under smoking conditions are preferably employed. Such salts are, for example, the salts of monobasic and polybasic carboxylic acids with cations such as ammonium, alkali metal, alkaline earth metal, iron, aluminium, manganese or zinc ions. Carboxylic acids which have proved suitable are, above all, oxalic acid, glycollic acid, tartaric acid, citric acid and lactic acid. These salts can be simple salts, for example ammonium oxalate, iron citrate or zinc tartrate, or preferably complex salts, such as ammonium iron-III oxalate, ammonium iron-III citrate or ammonium aluminium citrate. Particularly preferentially, complex salts having a chelate structure of the formula $$K_z[Me_xR_y] \qquad \text{I}$$

in which

K denotes magnesium, calcium or manganese-II,

Me denotes iron-III or aluminium and

R denotes the radical of a chelate-forming carboxylic acid and x represents 1 or 2 and y represents 1, 2 or 3 and z indicates the number of divalent cations K which are necessary to neutralise the anionic chelate complex, are used.

The combustible material based on cellulose employed in the smokable products according to the invention is cellulose-containing vegetable material and also cellulose or pulps or cellulose derivatives, on their own or mixed with one another. Particularly good results are obtained when paper-like webs of tobacco, tobacco waste products or cellulose or pulps are used. The smokable products according to the invention contain 0.5–15% by weight, based on the total weight of the smokable product, of combustion-modifying agents. Salts of monobasic or polybasic carboxylic acids, for example the ammonium, alkali metal, alkaline earth metal, iron, aluminium, manganese and zinc salts of oxalic acid, tartaric acid, citric acid, lactic acid and glycollic acid, have proved suitable. These salts can be simple salts or complex salts, such as ammonium iron-III oxalate, ammonium iron-III citrate or ammonium aluminium citrate.

Preferred combustion-modifying agents are the complex salts having a chelate structure of the formula I, which have been described above.

Furthermore, the base material used to prepare the smokable products according to the invention can contain customary fillers. The fillers are appropriately employed in amounts of about 1–70% by weight, preferably 2–60% by weight, based on the total weight of the smokable product.

The smokable products according to the invention can contain customary compounds which split off ammonia under smoking conditions. The compounds which split off ammonia under smoking conditions which are used are in particular ammonium salts of inorganic and organic acids and also salts of aminoacids and acid amides. The compounds which split off ammonia are employed, for example, in amounts of about 1 to 25% by weight, so that a pH value of about 5–8 results in the main stream of smoke.

Furthermore, the smokable products according to the invention can contain, based on the total weight of the smokable product, 0.01–7, preferably 1–5, % by weight of an oxidising agent. Oxidising agents are to be understood as meaning substances which improve the smouldering characteristics of the smokable products, for example potassium nitrate or sodium nitrate.

Furthermore, the smokable products according to the invention can contain about 0.01–10% by weight, preferably 0.1–5% by weight, based on the smokable product, of ammonium salts of polygalacturonic acids, such as pectin, alginic acid or gum arabic and/or ammonium salts of carboxymethylcellulose.

An addition of 0.01–5% by weight and preferably of 0.1–3% by weight, based on the smokable product, of protein substances having a low sulphur content, such as zein, hordeine or gliadin, and also the extracts obtained from these protein substances by fractional extraction with alcohol, for example by extraction with ethanol, can be advantageous for the organoleptic properties of the smokable products according to the invention. Furthermore, the smokable products according to the invention can contain about 0.1–50% by weight, based on the total weight of the smokable product, of tobacco constituents.

The abovementioned additives customarily used in products for smoking can already be added during the preparation of the starting material to be treated according to the invention or can be added only during the treatment, according to the invention, of this starting material with the solids dispersed in the salt solutions.

It has proved particularly advantageous to produce the products according to the invention in the form of paper-like webs having a weight per unit area of 10–150 $g/m^2$, preferably 30–80 $g/m^2$, and with sheet thicknesses which generally lie in the range of about 10–120$\mu$, preferably about 30–90$\mu$ and particularly preferentially about 55–70$\mu$.

The smokable products according to the invention are produced by saturating, spraying or coating the combustible material based on cellulose, which can be used as the smokable product and has been prefabricated, that is to say is in the form of a paper-like web, a fibre web, a film, a filament or a hank and is cut or uncut and optionally contains conventional fillers, with the dispersions, to be used according to the invention, of the solids in solutions of salts of monobasic or polybasic carboxylic acids. Saturation can be effected, for example, by immersing the combustible material in the dispersion of the solids and subsequently drying it. Drying is generally carried out at temperatures of 50°–120° C.

The combustible prefabricated materials used for the production of the smokable products according to the invention are preferably paper-like webs or fibre webs.

In all embodiments it is furthermore possible additionally to introduce, in the same or in separate process steps, the additives customary in tobacco processing, for example humectants and "flavour" and nicotine.

On smoking, the smokable products according to the invention display, compared with the combustible material which has been used to produce them and to which known combustion-modifying substances have been admixed, organoleptically improved characteristics, in particular reduced sharpness, a pleasantly mild taste and an improved compatibility with various, preferably low-nicotine and low-condensate, tobaccos. Furthermore, when mixed with tobacco, the smokable products according to the invention effect a considerable reduction in the content of harmful substances in the smoke and this is of increasing interest for the production of products for smoking having a lesser health risk. Thus, for example, with a smokable product, produced according to U.S. Pat. No. 3,924,642, which contains 35% by weight, based on the total weight of the smokable products, of the combustion-modifying agents described in U.S. Pat. No. 3,924,642 and has satisfactory organoleptic properties, in mixtures comprising 75 parts by weight of tobacco and 25 parts by weight of the smokable product, a relative reduction in the condensate value to 65–70% and in the nicotine content to about 85% is achieved, whilst the amount of carbon monoxide increases to 110–115% (based on tobacco = 100%). Although a reduction in the amount of combustion-modifying agents in the smokable products described to below the preferred range does lead to a further reduction in the concentration of harmful substances in the smoke, the organoleptic properties of the products at the same time deteriorate, so that the characteristic cellulose taste, coupled with a sharp, irritating component, becomes distinctly pronounced, and the compatibility with tobaccos and tobacco mixtures is restricted (compare Table 1, page 13).

Smokable products according to the present invention, which, for example, have additionally been loaded with 5% by weight of finely divided (peptised) hydrated iron oxide of the formula $Fe_2O_3.n\ H_2O$ in heterogeneous distribution, have excellent organoleptic properties without any cellulose sharpness and are completely compatible with varieties of tobacco of various origin, especially with low-nicotine and low-condensate tobacco mixtures, without impairing the specific taste and aroma components of such tobaccos. On the contrary, when mixed with tobaccos, the smokable products according to the invention allow the taste impression characteristic for the different varieties of tobacco to stand out markedly.

Moreover, when mixed with tobacco, these smokable products have an advantageous effect on the combustion characteristics of the total mixture and effect a considerable, disproportionate reduction in the concentration of harmful substances in the smoke, which cannot be expected on the basis of the individual values of the components of the mixture.

Thus, for example, for admixtures of 25 parts by weight of the smokable products according to the invention and 75 parts by weight of tobacco, condensate values of 45–60%, values for nicotine of 55–65% and an amount of carbon monoxide of 80–90% are found (based on tobacco = 100%).

TABLE 1

Typical analysis values for comparison products and smokable products according to the invention

| | Smoke analysis | | | | | | Organoleptic assessment | |
|---|---|---|---|---|---|---|---|---|
| | Change in the amount of condensate* | | Change in the amount of nicotine* | | Change in the amount of CO* | | | |
| | calculated | found | calculated | found | calculated | found | Sharpness | Smoke taste |
| Smokable products containing 35% by weight of combustion-modifying agents (Example A) | about 85 | 65–70 | 75 | about 75 | about 110 | 110–115 | (– –) | (– –) |

TABLE 1-continued

Typical analysis values for comparison products and smokable products according to the invention

| | Smoke analysis | | | | | | Organoleptic assessment | |
|---|---|---|---|---|---|---|---|---|
| | Change in the amount of condensate* | | Change in the amount of nicotine* | | Change in the amount of CO* | | | |
| | calculated | found | calculated | found | calculated | found | Sharpness | Smoke taste |
| Smokable products containing 2% by weight of combustion-modifying agents (Example B) | about 80 | 55–60 | 75 | about 70 | about 100 | 90–98 | (+) | (+) |
| Smokable products containing 2% by weight of combustion-modifying agents and 5% by weight of homogeneously distributed $Fe_2O_3 \cdot n\ H_2O$ (Example C) | about 80 | 55–60 | 75 | about 70 | about 100 | 90–98 | (+) | (+) |
| Smokable products according to the invention containing heterogeneously distributed dispersed solids (Examples 1-3) | about 80 | 45–60 | 75 | 55–65 | about 100 | 80–90 | (− −) | (− −) |

*based on tobacco = 100%

The desired advantageous effects, that is to say the improvement in the organoleptic properties, the increase in the compatibility with tobaccos having less taste, condensate and nicotine and the disproportionate reduction in the values for the harmful substances, cannot be achieved, or can be achieved only to a lesser extent, when the precipitated hydrated iron oxide is uniformly distributed in the smokable products, say is incorporated together with the filler during the production of the paper-like starting material (see Example C, Table 1, page 13).

Typical analysis values such as are obtained with tobacco, comparison products and the smokable products according to the invention, the corresponding relative reductions and the organoleptic assessment are summarised, for filter cigarettes consisting of 75% by weight of tobacco and 25% by weight of the smokable products, in Table 2, page 21.

The smokable products according to the invention can be used on their own or, preferably, as mixing components in cigarette tobacco, cigar tobacco and pipe tobacco. They can also be employed as the wrapper or binder of a cigar or as cigarette paper.

Notes on the Examples which follow:

The smokable products, the preparation of which is described in the Examples which follow, were processed as a mixture with 75% by weight of a commercially available tobacco mixture of a light rating (taste type American blend) to filter cigarettes with a cellulose acetate filter. The filter cigarettes had a length of 82 mm, a diameter of 8 mm and a tow length of 67 mm. The cigarettes were smoked to an average butt length of 23 mm.

The draw resistance was given to characterise the packing density of the cigarettes. The draw resistance was determined using a draw resistance measuring apparatus for individual cigarettes from Messrs. Filtrona, London, which indicates the pressure drop in "mm $H_2O$". Filter cigarettes produced from the smokable products and having draw resistances of between 50 and 75 mm $H_2O$ were employed for the analytical and organoleptic test.

The amounts of condensate indicated in the Examples are dry condensate in mg/cigarette. The condensate was determined according to Coresta Standard No. 10. The test cigarettes were smoked with a draw volume of 35 ml, a draw time of 2 seconds and a draw frequency of 60 seconds. The condensate formed was precipitated on a Cambridge filter and weighed. The water content was determined by titration using the Karl-Fischer method and subtracted from the total condensate. The nicotine content in the main stream of smoke was determined after steam distillation by spectrophotometry by measuring at wavelengths of 236 nm, 259 nm, 259 nm and 282 nm in accordance with the procedure indicated in K. Rothwell, C. A. Grant, Standard Methods for the Analysis of Tobacco Smoke, Tobacco Research Council, Research Paper No. 11, London, 1974. In each case, the cigarette filters through which smoke had been drawn, from 10 cigarettes, and the condensate precipitated on the Cambridge filters in the smoking machine, were used for the determination and the nicotine content was given as mg of nicotine per cigarette.

In order to determine the carbon monoxide formed during smoking under standard conditions, the gas phase of the main stream of smoke was collected, after filtration through a Cambridge filter, over carbon monoxide-saturated water, the carbon monoxide content in the gas phase collected was determined using a CO tester from Messrs. Hartmann & Braun AG, Frankfurt and the values were given as ml/cigarette.

Comparison cigarettes of a commercially available cigarette tobacco mixture (base tobacco) without the addition of the smokable products according to the invention were characterised by the following analytical values:

| | |
|---|---|
| draw resistance: | 66 mm $H_2O$ |
| condensate: | 14.2 mg |
| nicotine: | 1.80 mg |
| carbon monoxide | 11.4 ml |

The organoleptic properties of the smokable products, the preparation of which is described in the Examples which follow, were assessed and graded as follows:

(a) Sharpness:

(+ +) customary cellulose sharpness (+) slight sharpness, above all when starting to smoke
(−) virtually no sharpness, corresponding to tobacco material
(− −) completely without sharpness
(b) Smoke taste:
(+ +) strong customary cellulose taste, burning paper, highly astringent
(+) slight cellulose taste, not astringent
(−) no cellulose taste, slight impairment of the taste
(− −) mild, no impairment of the taste

COMPARISON EXAMPLE A (Smokable product according to U.S. Pat. No. 3,924,642)

A paper-like web of bleached sulphate pulp containing 50% by weight of calcium carbonate as the filler and having a weight per unit area of 50 g/m$^2$ and a thickness of about 60$\mu$ was saturated in a size bath with an aqueous solution of 100 g/l of magnesium iron-III citrate, 30 g/l of manganese iron-III citrate, 30 g/l of ammonium iron-III citrate, 60 g/l of ammonium citrate and 50 g/l of urea, pressed between rollers and dried. The increase in weight of the dried product was 35%, based on the total weight.

The sheet was cut into strips about 0.9 mm broad and of varying length, mixed with the base tobacco in a weight ratio of 25 parts of smokable product: 75 parts of tobacco and processed to cigarettes using commercially available cigarette paper tubes with cellulose acetate filters.

See Table 2 for the smoke analysis and the organoleptic assessment.

COMPARISON EXAMPLE B (Smokable product according to U.S. Pat. No. 3,924,642)

The procedure was as described in Comparison Example A, the sole difference being that the salt content of the dipping solution was only 1/20th of the salt content of the dipping solution used in Comparison Example A. The increase in weight of the dried product was 2%, based on the total weight.

See Table 2 for the smoke analysis and the organoleptic assessment.

COMPARISON EXAMPLE C (Smokable product according to U.S. Pat. No. 3,924,642

The procedure was as described in Comparison Example B, the sole difference being that the paper-like web of bleached sulphate pulp which was used also contained, in addition to the 50% by weight of calcium carbonate, 5% by weight of hydrated iron-III oxide (calculated as $Fe(OH)_3$) in homogeneous distribution. The increase in weight of the dried web was 2.5%.

See Table 2 for the smoke analysis and the organoleptic assessment.

EXAMPLE 1

A paper-like web of bleached sulphate pulp containing 50% by weight of calcium carbonate as the filler was saturated with a dispersion which contained, per liter, 50.0 g of $Fe_2O_3 \times n\ H_2O$ (calculated as $Fe(OH)_3$), 5.0 g of magnesium iron-III citrate, 1.5 g of manganese iron-III citrate, 1.5 g of ammonium iron-III citrate, 3.0 g of ammonium citrate and 2.5 g of urea, pressed between rollers and dried. The increase in weight of the dried product was 8%, based on the total weight of the web.

The dispersing apparatus Ultraturrax from Messrs. Janke and Kunkel was used to disperse the hydrated iron oxide in the salt solution. Dispersing time: 10 minutes. Even after standing for 1 hour, no hydrated iron oxide had flocculated out from the resulting dispersion.

The hydrated iron oxide used to prepare the dispersion had been prepared as follows:

Iron hydroxide was precipitated from a solution of 3 mols of $FeCl_3.6H_2O$ in 2 l of water, at 70° C., whilst stirring, by adding 750 ml of 25% strength aqueous ammonia solution. The precipitate was washed thoroughly, on a suction filter, with desalinated water until its chloride ion content had fallen to below 5%, based on the weight of the hydroxide precipitate.

The resulting product for smoking was processed with tobacco to filter cigarettes, as described in Comparison Example A.

EXAMPLE 2

The procedure was as described in Example 1, the sole difference being that the paper-like web of bleached sulphate pulp which was used also contained, in addition to the 50% by weight of calcium carbonate, 5% by weight of homogeneously distributed hydrated iron-III oxide (calculated as $Fe(OH)_3$).

The increase in weight of the dried paper web was 7.5%, based on the total weight. The resulting product for smoking was processed with tobacco to filter cigarettes, as described in Comparison Example A.

See Table 2 for the smoke analysis and the organoleptic assessment.

EXAMPLE 3

A paper-like sheet with a filler content, based on the sheet weight, of 43% by weight of calcium carbonate and 5% by weight of hydrated iron-III oxide (calculated as $Fe(OH)_3$), a weight per unit area of about 55 g/m$^2$ and a thickness of about 70$\mu$ was produced from bleached sulphate pulp on a sheet forming apparatus. After drying, this sheet was immersed in an aqueous dispersion which contained, per liter, 100 g of $Al_2O_3.nH_2O$ (calculated as $Al(OH)_3$) which had been prepared and dispersed as described for hydrated iron-III oxide in Example 1 and was dispersed in a stable manner, and also 5.5 g of magnesium iron-III citrate, 1.0 g of manganese iron-III citrate, 2.5 g of ammonium iron-III citrate, 2.0 g of ammonium citrate and 2.5 g of urea.

After pressing and drying, the increase in weight of the sheet was 14.5%, based on the total weight.

The resulting product for smoking was processed with tobacco to filter cigarettes, as described in Comparison Example A.

See Table 2 for the smoke analysis and the organoleptic assessment.

EXAMPLE 4

A dispersion of hydrated aluminium oxide which contained, per liter, 3% by weight of $Al_2O_3.nH_2O$ (calculated as $Al(OH)_3$ prepared from aluminium chloride and washed free from chloride ions, and 2.5% by weight of magnesium aluminium citrate was prepared in the manner described in Example 1 for the preparation of the dispersion of hydrated iron-III oxide.

This dispersion was applied in the manner described in Example 1 to the paper-like web also described in Example 1.

The increase in weight of the dried material was 6.5%, based on the total weight. The smokable product was processed with tobacco to filter cigarettes, as described in Comparison Example A.

Smoke analysis and organoleptic assessment:

| | |
|---|---|
| Draw resistance: | 68 nm $H_2O$ |
| Smoke analysis: | |
| condensate: | 7.3 mg |
| nicotine: | 1.05 mg |
| carbon monoxide: | 9.8 ml |
| Organoleptic assessment: | |
| Sharpness: | (– –) |
| Smoke taste: | (– –) |

TABLE 2

Smoke analysis and organoleptic assessment of tobacco, comparison products and smokable products according to the invention

| | Draw resistance | Smoke analysis | | | | | | Organoleptic assessment | |
|---|---|---|---|---|---|---|---|---|---|
| | | Condensate | | Nicotine | | Carbon monoxide | | | |
| | mm $H_2O$ | mg/cigarette | % rel. | mg/cigarette | % rel. | ml/cigarette | % rel. | Sharpness | Smoke taste |
| Tobacco | 66 | 14.2 | 100 | 1.80 | 100 | 11.4 | 100 | (– –) | (– –) |
| Example A | 51 | 9.4 | 66.2 | 1.35 | 75.0 | 12.8 | 112 | (– –) | (– –) |
| Example B | 59 | 8.3 | 58.5 | 1.22 | 67.8 | 10.9 | 96.0 | (+) | (+) |
| Example C | 66 | 8.1 | 57.0 | 1.19 | 66.1 | 10.6 | 93.4 | (+) | (+) |
| Example 1 | 63 | 7.3 | 51.4 | 1.06 | 59.0 | 9.4 | 82.5 | (– –) | (– –) |
| Example 2 | 58 | 7.0 | 49.3 | 1.04 | 57.6 | 9.7 | 85.3 | (– –) | (– –) |
| Example 3 | 65 | 7.5 | 52.8 | 1.10 | 61.2 | 9.4 | 83.2 | (– –) | (– –) |

EXAMPLE 5

8.95 g of $FeCl_3.6H_2O$ were added to a dispersion of 100 g of commercially available titanium dioxide of the rutile type in 1.8 l of water. A solution of 12.6 g of $Na_3PO_4.12H_2O$ in 50 ml of $H_2O$ was added dropwise to the mixture in the course of 15 minutes, whilst stirring vigorously. The precipitate was separated off and washed thoroughly with pure water by centrifuging.

The resulting finely divided particles of titanium dioxide coated with 5% by weight of precipitated iron phosphate were dispersed in the manner described in Example 1 in a solution of ammonium iron-III oxalate, so that a dispersion which contained 8% by weight of dispersed solid and 1.5% by weight of dissolved ammonium iron-III oxalate was obtained. The paper-like web described in Example 1 was coated with this dispersion. The increase in weight was 12.4%, based on the total weight of the smokable product.

The smokable product was processed with tobacco to filter cigarettes, as described in Comparison Example A.

| | |
|---|---|
| Draw resistance: | 60 nm $H_2O$ |
| Smoke analysis: | |
| condensate: | 7.5 mg |
| nicotine: | 1.06 mg |
| carbon monoxide: | 9.5 ml |
| Organoleptic assessment: | |
| sharpness: | (– –) |
| smoke taste: | (+) |

What is claimed is:

1. A process for the preparation of a smokable product based on cellulose and combustion-modifying substances which comprises saturating, spraying or coating a combustible, prefabricated material which is based on cellulose and optionally contains fillers customerily used in smokable products and which can be used as a smokable product with an electrostatically stabilized dispersion of solids as the internal phase in an external aqueous phase, the solids being electrically charged and having an average particle diameter of less than 2μ, the aqueous phase being a solution of salts of monobasic or polybasic carboxylic acids, whereby the solids are preferentially distributed on the surfaces of the smokable product.

2. A smokable product based on cellulose and combustion-modifying substances and produced by the process of claim 1.

3. A smokable product according to claim 1, which contains (a) 0.1–10% by weight, based on the total weight of the smokable product, of finely divided solids, the average particle diameter of which is less than 2μ, in a distribution which is preferentially on the surfaces, and (b) 0.5–15% by weight, based on the total weight of the smokable product, of salts of monobasic or polybasic carboxylic acids.

4. A smokable product according to claim 1, wherein the solids comprise carbon and/or inorganic oxygen compounds of polyvalent elements and the salts comprise ammonium, alkali metal, alkaline earth metal, iron, aluminium, manganese or zinc salts of oxalic acid, glycollic acid, tartaric acid, citric acid or lactic acid, or mixtures thereof.

5. Process according to claim 1 wherein the average particle diameter of the solids is 1.5 to 0.01μ.

6. Process according to claim 1 wherein as salts of monobasic or polybasic carboxylic acids are used the ammonium, alkali metal, alkaline earth metal, aluminium, iron, manganese or zinc salts of oxalic acid, glycollic acid, tartaric acid, citric acid or lactic acid, or mixtures thereof.

7. Process according to claim 1 wherein as salts of monobasic or polybasic carboxylic acids are used complex salts having a chelate structure of the formula $$K_z[Me_xR_y]$$

or mixtures thereof, in which

K denotes magnesium, calcium or manganese-II,

Me denotes iron-III or aluminium and

R is the radical of a chelate-forming carboxylic acid and x represents 1 or 2, y represents 1, 2 or 3 and z indicates the number of divalent cations which are necessary to neutralise the anionic chelate complex.

8. Process according to claim 1 wherein the concentration of the salts of their mixtures in the salt solutions is 0.5–15% by weight.

9. Process according to claim 1 wherein the concentrations of the salts or their mixtures in the salt solutions is 1–5% by weight.

10. Process according to claim 1 the solids used are carbon and/or inorganic oxygen compounds of polyvalent elements or mixtures thereof.

11. Process according to claim 10 wherein as inorganic oxygen compounds of polyvalent elements are used the oxides, hydroxides and/or hydrated oxides of aluminium, iron, manganese, zinc, titanium or silicon, or mixtures thereof.

12. Process according to claim 1 wherein the concentration of the solids in the dispersion is 0.1–10% by weight.

* * * * *